US007013623B2

(12) United States Patent
Fisher et al.

(10) Patent No.: US 7,013,623 B2
(45) Date of Patent: Mar. 21, 2006

(54) PROCESS FOR PRODUCTION OF POUCHES

(75) Inventors: Wayne Robert Fisher, Cincinnati, OH (US); Gregory Martin Gressel, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 155 days.

(21) Appl. No.: 10/266,228

(22) Filed: Oct. 8, 2002

(65) Prior Publication Data

US 2003/0077005 A1 Apr. 24, 2003

Related U.S. Application Data

(60) Provisional application No. 60/328,012, filed on Oct. 8, 2001.

(51) Int. Cl.
*B65B 47/00* (2006.01)

(52) U.S. Cl. ..... 53/453; 53/455; 53/464

(58) Field of Classification Search ..... 53/453, 53/427, 455, 456, 464, 559, 470, 474, 450, 53/475, 476, 432, 478; 493/123, 143
See application file for complete search history.

(56) References Cited

U.S. PATENT DOCUMENTS 3,825,058 A * 7/1974 Miura et al. ..... 164/253
4,240,241 A * 12/1980 Sanborn, Jr. ..... 53/412
4,254,910 A * 3/1981 Martin ..... 239/60
4,621,483 A 11/1986 Magid
5,085,031 A * 2/1992 McDonald ..... 53/412
5,224,601 A 7/1993 Gouge et al.
5,724,789 A * 3/1998 Corella ..... 53/450
6,727,215 B1 * 4/2004 Roberts et al. ..... 510/296
6,831,051 B1 * 12/2004 Sommerville-Roberts et al. ..... 510/296
6,878,679 B1 * 4/2005 Sommerville-Roberts et al. ..... 510/296
6,883,295 B1 * 4/2005 Negri et al. ..... 53/459

FOREIGN PATENT DOCUMENTS

EP 1 126 070 A1 8/2001
GB 2 025 450 A 1/1980
WO WO 00/55415 9/2000

* cited by examiner

*Primary Examiner*—Sameh H. Tawfik
(74) *Attorney, Agent, or Firm*—Armina E. Matthews; Ian S. Robinson; Steven W. Miller

(57) ABSTRACT

A process for the production of water-soluble pouches. The process comprises the steps of drawing a first film into a mould to form a first compartment, adding composition to the first compartment, drawing a second film into the mould to form a second compartment which comprises a composition and, preferably, sealing. The first film is perforated and the second film is drawn into the mould by means of suction applied through the first film. This eliminates the need to align separately formed pouches or containers. This also reduces the total amount of film needed to produce a multi-compartment pouch. Furthermore, it is very easy to vary the film material used according to what properties are desired. Since the different compartments may require different properties this adds flexibility to the process.

Process particularly suited for the production of water soluble pouches such as cleaning or fabric care pouches.

6 Claims, No Drawings

PROCESS FOR PRODUCTION OF POUCHES

CROSS REFERENCE TO RELATED APPLICATIONS

This application claims priority under 35 U.S.C. §119(e) to U. S. Provisional Application Ser. No. 60/328,012, filed Oct. 8, 2001.

TECHNICAL FIELD

The present invention relates to a process for the production of water-soluble pouches, particularly for the production of cleaning or fabric care pouches.

BACKGROUND TO THE INVENTION

Pouch compositions are known in the art. These compositions are easy to dose, handle, transport and store. Usually the pouches are formed by placing two sheets of film together, heat sealing three edges, filling and then heat-sealing the forth edge. Recently, water-soluble pouches containing cleaning or fabric care compositions have become popular. It is desirable that cleaning or fabric care compositions contain certain actives that are often incompatible with one another or are more efficient when released at different times in the wash cycle. Therefore, it is advantageous to formulate a pouch with two or more distinct phases which are usually contained in different compartments. Multi-compartment pouches are known. See, for example, U.S. Pat. No. 5,224,601 which discloses a package which contains a toxic composition and is divided into two compartments. However, for a variety of reasons, it is difficult to quickly and efficiently produce such multi-phase/multi-compartment pouches using prior art methods. For example, when forming a multi-compartment pouch it is often difficult to accurately align the different films with each other meaning production is slowed and quality is not properly controlled. In addition, prior art methods of forming multi-compartment pouches often damage the film material due to the mechanical forces necessary to place and hold the film in the correct position.

The present invention provides a way of quickly and efficiently forming multi-phase pouches The present process allows the multi-phase pouch to be formed in a single mould and helps mitigate the problems associated with prior art methods especially the problem of aligning the films.

SUMMARY OF THE INVENTION

The present invention relates to a process for the production of water-soluble pouches. The process comprises the steps of drawing a first film into a mould to form a first compartment, adding composition to the first compartment, drawing a second film into the mould to form a second compartment which comprises composition and, preferably, sealing. The present process is characterised in that the first film is perforated and the second film is drawn into the mould by means of suction applied through the first film. This eliminates the need to align separately formed pouches or containers. Also, in comparison with prior art processes, reduces the total amount of film to produce a multi-compartment pouch. Another advantage is that it is very easy to vary the film material used according to what properties are desired. Since the different compartments may require different properties this adds flexibility to the process.

The present process is particularly suited for the production of water soluble pouches such as cleaning or fabric care pouches.

DETAILED DESCRIPTION OF THE INVENTION

The process herein must comprise the step of drawing a first film into a mould to form a first compartment. The film may be drawn into the mould by use of any suitable means but, preferably, is drawn in by use of suction. The mould can be any suitable shape such as rectangular, square, circular or oval. Preferred are circular or square moulds. The mould preferably has a depth of from 0.5 cm to 10 cm, more preferably from 1 cm to 5 cm. The diameter of the mould is preferably from 2 cm to 15 cm, more preferably from 3 cm to 10 cm (the diameter being the distance between the two points on the edge of the mould that are farthest apart).

Product must then be added to said first compartment. Preferably from 10 g to 100 g, more preferably from 20 g to 80 g, even more preferably from 25 to 70 g, of product is added.

The process herein must also comprise a step wherein a second film is drawn into the mould by means of suction applied through at least one perforation in the first film. The perforation(s) can be of any suitable size or shape but preferably has a diameter of less than 2 mm, more preferably less than 1 mm, even more preferably less than 0.5 mm. If the perforation is too large, powder can slowly spill through the film. The first film can be pre-perforated or the perforation(s) can be made during the process. The first film can be formulated so that the perforation forms during the process as a result of the stresses, such as stretching, placed on the film during the process. Preferably the first film is drawn into the mould and then perforated. The perforation can be produced using any suitable means. Preferably the perforation(s) in the film is (are) aligned with one or more of vacuum holes in the mold. Preferred means include mechanical perforation using pins or perforating by use of a laser.

In the process herein the second film is drawn into the mould by use of a low pressure applied through the perforation(s) in the first film. This low pressure can be of any suitable strength but is preferably from 950 to 30 mbar absolute, more preferably from 800 to 60 mbar absolute, even more preferably from 600 to 90 mbar absolute.

This drawing down of the second film can be used to compact the composition in the first compartment. Alternatively mechanical compaction, either by vibration or compression, can be used to compact the powder either pre or post the low pressure being applied to the second film.

The second compartment must comprise a composition and can be filled after it has been drawn into the mould or it can be pre-filled with product before it is drawn into the mould. If it is pre-filled then it is preferably a sealed pouch before it is added to the mould. The second compartment preferably comprises from 1 g to 50 g, more preferably from 5 g to 35 g, of product.

In addition to the above essential steps, the process herein preferably comprises a step which involves the addition of a further film. Preferably, this third film covers only the second compartment forming a shaped body comprising three films and two compartments.

Further films may be added to the pouch either to form further compartments comprising product or to modify the properties of the pouch (e.g. rate of dissolution or robustness of the pouch).

Another, highly preferred step is sealing the films together after the second compartment has been formed and, if necessary, filled. If further films have been added it is preferred that all the films are sealed together. The sealing can be achieved by conventional means such as heat-sealing but, preferably, is achieved by solvent-welding. As used herein the term "solvent-welding" refers to the process of forming at least a partial seal between two or more layers of film material by use of a solvent such as water. This does not exclude that heat and pressure may also be applied to form a seal. Any suitable solvent may be used herein. It is preferred that the solvent has a viscosity in the range 0.5 to 15,000 mPa.s, preferably from 2 to 13,000 mPa.s (measured by DIN 53015 at 20° C.). Preferred solvents for use herein comprise plasticiser, for example 1,2 propanediol, and water. A preferred sealing process involves applying solvent comprising plasticiser to the film and then applying heat and/or pressure. The temperature is preferably from 30° C. to 250° C., more preferably from 50° C. to 200° C. The pressure is preferably from 10 $Nm^{-2}$ to $1.5\times10^{7}$ $Nm^{-2}$, more preferably from 100 $Nm^{-2}$ to $1\times10^{5}$ $Nm^{-2}$.

Therefore, a preferred process according to the present invention comprises the steps:

(a) drawing a first film into a mould to form a first compartment, (b) adding product to said first compartment, (c) forming a second compartment by drawing a second film into said mould by means of suction applied through at least one perforation in said first film, (d) adding product to said second compartment, (e) covering the second compartment with a further film, and (f) sealing.

The process herein can make use of a die having series of moulds and forming from a film, open pouches in these moulds to which product can be added, forming another compartment with film and adding product to the second compartment. Preferably a third film is added over the second compartment and then the pouch is sealed. A preferred process herein is a horizontal, continuous process whereby a horizontally positioned portion of an endless surface with moulds (in two dimensions), which moves continuously in one direction, is used to form the pouches, namely whereby a film is continuously fed onto this surface, and then, the film is drawn into the moulds on the horizontal portion of the surface, to continuously form a web of open pouches positioned in horizontal position, to which product is added, whilst horizontal and whilst moving continuously. A second film can then be drawn into the mould and product is added to the second compartment formed thereof. Preferably a third film is added over the second compartment and then the pouch is sealed whilst still horizontal and moving continuously.

A preferred process herein is to use an intermittent, indexing, thermoforming process. The process includes the following steps.

(a) drawing a first film into a mold by a momentary application of vacuum, preferably after said film has been heated.

(b) perforating the first film.

(c) filling the compartment with particulate.

(d) sealing a second film onto the first film.

(e) preferably heating the second film.

(f) applying vacuum briefly through the perforations to draw the second film down onto the powder.

(g) adding liquid into the second compartment thus formed by the drawing down of the second film.

(h) sealing a third film onto the second film.

The films can be sealed by heat-sealing or preferably by solvent-welding.

Film Material

It is preferred that the film used herein whole comprises material which is water-dispersible or more preferably water-soluble. Preferred water-soluble films are polymeric materials, preferably polymers which are formed into a film or sheet. The material in the form of a film can for example be obtained by casting, blow-moulding, extrusion or blow extrusion of the polymer material, as known in the art. Preferred water-dispersible material herein has a dispersability of at least 50%, preferably at least 75% or even at least 95%, as measured by the method set out hereinafter using a glass-filter with a maximum pore size of 50 microns. More preferably the material is water-soluble and has a solubility of at least 50%, preferably at least 75% or even at least 95%, as measured by the method set out hereinafter using a glass-filter with a maximum pore size of 50 microns, namely:

Gravimetric method for determining water-solubility or water-dispersability of the material of the compartment and/or pouch:

50 grams±0.1 gram of material is added in a 400 ml beaker, whereof the weight has been determined, and 245 ml±1 ml of distilled water is added. This is stirred vigorously on magnetic stirrer set at 600 rpm, for 30 minutes. Then, the mixture is filtered through a folded qualitative sintered-glass filter with the pore sizes as defined above (max. 50 micron). The water is dried off from the collected filtrate by any conventional method, and the weight of the remaining polymer is determined (which is the dissolved or dispersed fraction). Then, the percentage solubility or dispersability can be calculated.

The polymer can have any weight average molecular weight, preferably from about 1000 to 1,000,000, or even form 10,000 to 300,000 or even form 15,000 to 200,000 or even form 20,000 to 150,000.

Preferred film materials are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferably the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, polyvinyl alcohols, polyvinyl alcohol copolymers and hydroxypropyl methyl cellulose (HPMC), and mixtures thereof. Most preferred are polyvinyl alcohols. Preferably, the level of a type polymer (e.g., commercial mixture) in the film material, for example PVA polymer, is at least 60% by weight of the film.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the compartment, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000–40,000, preferably around 20,000, and of PVA or copolymer thereof, with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1–35% by weight polylactide and approximately from 65% to 99% by weight polyvinyl alcohol, if the material is to be water-dispersible, or water-soluble. It may be preferred that the PVA present in the film is from 60–98% hydrolysed, preferably 80% to 90%, to improve the dissolution of the material.

Most preferred are films, which are water-soluble and stretchable films, as described above. Highly preferred water-soluble films are films which comprise PVA polymers and that have similar properties to the film known under the trade reference M8630, as sold by Chris-Craft Industrial Products of Gary, Ind., US and also PT-75, as sold by Aicello of Japan.

The water-soluble film herein may comprise other additive ingredients than the polymer or polymer material. For example, it may be beneficial to add plasticisers, for example glycerol, ethylene glycol, diethyleneglycol, propylene glycol, sorbitol and mixtures thereof, additional water, disintegrating aids. It may be useful that the pouch or water-soluble film itself comprises a detergent additive to be delivered to the wash water, for example organic polymeric soil release agents, dispersants, dye transfer inhibitors.

It is preferred that the water-soluble film is stretched during formation and/or closing of the pouch, such that the resulting pouch is at least partially stretched. This is to reduce the amount of film required to enclose the volume space of the pouch. When the film is stretched the film thickness decreases. The degree of stretching indicates the amount of stretching of the film by the reduction in the thickness of the film. For example, if by stretching the film, the thickness of the film is exactly halved then the stretch degree of the stretched film is 100%. Also, if the film is stretched so that the film thickness of the stretched film is exactly a quarter of the thickness of the unstretched film then the stretch degree is exactly 200%. Typically and preferably, the thickness and hence the degree of stretching is non-uniform over the pouch, due to the formation and closing process. For example, when a water-soluble film is positioned in a mould and an open compartment is formed by vacuum forming (and then filled with the components of a composition and then closed), the part of the film in the bottom of the mould, furthest removed from the points of closing will be stretched more than in the top part. Preferably, the film which is furthest away from the opening, e.g. the film in the bottom of the mould, will be stretched more and be thinner than the film closest by the opening, e.g. at the top part of the mould.

Another advantage of using stretching the pouch is that the stretching action, when forming the shape of the pouch and/or when closing the pouch, stretches the pouch non-uniformly, which results in a pouch which has a non-uniform thickness. This allows control of the dissolution of water-soluble pouches herein, and for example sequential release of the components of the detergent composition enclosed by the pouch to the water.

Preferably, the pouch is stretched such that the thickness variation in the pouch formed of the stretched water-soluble film is from 10 to 1000%, preferably 20% to 600%, or even 40% to 500% or even 60% to 400%. This can be measured by any method, for example by use of an appropriate micrometer. Preferably the pouch is made from a water-soluble film that is stretched, said film has a stretch degree of from 40% to 500%, preferably from 40% to 200%.

Composition

The pouches of the present invention can comprise a variety of compositions. The first and second compartments can comprise the same composition but preferably comprise different compositions. Unless stated otherwise all percentages herein are calculated based on the total weight of the all the composition but excluding the film.

Preferred are cleaning compositions, fabric care compositions, or hard surface cleaners. It is preferred that at least one of the compositions is a cleaning compositions, especially laundry or dish washing compositions including, pre-treatment or soaking compositions and other rinse additive compositions. The composition can be in any suitable form such as a liquid, a gel, a solid, or a particulate (compressed or uncompressed). Preferably the first compartment comprises a solid or a particulate. Most preferably the first compartment comprises a particulate.

Preferably the second compartment comprises a liquid or a gel. The composition(s) can comprise up to 15% by weight water, but preferably comprises less than 10%, preferably from 1% to 8%, more preferably from 2% to 7.5% by weight water. This is on basis of free water, added to the other ingredients of the composition.

The composition can made by any method and can have any viscosity, typically depending on its ingredients. The liquid/gel compositions preferably have a viscosity of 50 to 10000 cps (centipoises), as measured at a rate of 20 $s^{-1}$, more preferably from 300 to 3000 cps or even from 400 to 600 cps. The compositions herein can be Newtonian or non-Newtonian. The liquid composition preferably has a density of 0.8 kg/l to 1.3 kg/l, preferably around 1.0 to 1.1 kg/l.

In the compositions herein it is preferred that at least a surfactant and builder are present, preferably at least anionic surfactant and preferably also nonionic surfactant, and preferably at least water-soluble builder, preferably at least phosphate builder or more preferably at least fatty acid builder. Preferred is also the presence of enzymes and preferred may also be to incorporate a bleaching agent, such as a preformed peroxyacid. Highly preferred are also perfume, brightener, buffering agents, fabric softening agents, including clays and silicones benefit agents, suds suppressors, colorant or dye and/ or pearlescence agent.

In hard-surface cleaning compositions and dish wash compositions, it is preferred that at least a water-soluble builder is present, such as a phosphate, and preferably also surfactant, perfume, enzymes, bleach.

In fabric enhancing compositions, preferably at least a perfume and a fabric benefit agent are present for example a cationic softening agent, or clay softening agent, anti-wrinkling agent, fabric substantive dye.

Highly preferred in all above compositions are also additional solvents, such as alcohols, diols, monoamine derivatives, glycerol, glycols, polyalkylane glycols, such as polyethylene glycol. Highly preferred are mixtures of solvents, such as mixtures of alcohols, mixtures of diols and alcohols, mixtures. Highly preferred may be that (at least) an alcohol, diol, monoamine derivative and preferably even glycerol are present. The compositions of the invention are preferably concentrated liquids having preferably less than 50% or even less than 40% by weight of solvent, preferably less than 30% or even less than 20% or even less than 35% by weight. Preferably the solvent is present at a level of at least 5% or even at least 10% or even at least 15% by weight of the composition.

Preferably the compositions herein comprise surfactant. Any suitable surfactant may be used. Preferred surfactants are selected from anionic, amphoteric, zwitterionic, nonionic (including semi-polar nonionic surfactants), cationic surfactants and mixtures thereof. The compositions preferably have a total surfactant level of from 0.5% to 75% by weight, more preferably from 1% to 50% by weight, most preferably from 5% to 30% by weight of total composition. Detergent surfactants are well known and described in the art (see, for example, "Surface Active Agents and Detergents", Vol. I & II by Schwartz, Perry and Beach). Especially preferred are compositions comprising anionic surfactants. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate surfactants are preferred. Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

The composition can comprise a cyclic hydrotrope. Any suitable cyclic hydrotrope may be used. However, preferred hydrotropes are selected from salts of cumene sulphonate, xylene sulphonate, naphthalene sulphonate, p-toluene sulphonate, and mixtures thereof. Especially preferred are salts of cumene sulphonate. While the sodium form of the hydrotrope is preferred, the potassium, ammonium, alkanolammonium, and/or $C_2$–$C_4$ alkyl substituted ammonium forms can also be used.

The compositions herein may contain a $C_5$–$C_{20}$ polyol, preferably wherein at least two polar groups that are separated from each other by at least 5, preferably 6, carbon atoms. Particularly preferred $C_5$–$C_{20}$ polyols include 1,4 Cyclo Hexane Di Methanol, 1,6 Hexanediol, 1,7 Heptanediol, and mixtures thereof.

The compositions preferably comprise a water-soluble builder compound, typically present in detergent compositions at a level of from 1% to 60% by weight, preferably from 3% to 40% by weight, most preferably from 5% to 25% by weight of the composition.

Suitable water-soluble builder compounds include the water soluble monomeric carboxylates, or their acid forms, or homo or copolymeric polycarboxylic acids or their salts in which the polycarboxylic acid comprises at least two carboxylic radicals separated from each other by not more that two carbon atoms, and mixtures of any of the foregoing. Preferred builder compounds include citrate, tartrate, succinates, oxydissuccinates, carboxymethyloxysuccinate, nitrilotriacetate, and mixtures thereof.

Highly preferred may be that one or more fatty acids and/or optionally salts thereof (and then preferably sodium salts) are present in the detergent composition. It has been found that this can provide further improved softening and cleaning of the fabrics. Preferably, the compositions contain 1% to 25% by weight of a fatty acid or salt thereof, more preferably 6% to 18% or even 10% to 16% by weight. Preferred are in particular $C_{12}$–$C_{18}$ saturated and/or unsaturated, linear and/or branched, fatty acids, but preferably mixtures of such fatty acids. Highly preferred have been found mixtures of saturated and unsaturated fatty acids, for example preferred is a mixture of rape seed-derived fatty acid and $C_{16}$–$C_{18}$ topped whole cut fatty acids, or a mixture of rape seed-derived fatty acid and a tallow alcohol derived fatty acid, palmitic, oleic, fatty alkylsuccinic acids, and mixtures thereof.

The compositions herein may comprise phosphate-containing builder material. Preferably present at a level of from 2% to 40%, more preferably from 3% to 30%, more preferably from 5% to 20%. Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

The compositions herein may contain a partially soluble or insoluble builder compound, typically present in detergent compositions at a level of from 0.5% to 60% by weight, preferably from 5% to 50% by weight, most preferably from 8% to 40% weight of the composition. Preferred are aluminosilicates and/ or crystalline layered silicates such as SKS-6, available from Clariant.

It is preferred that the compositions herein comprise perfume. Highly preferred are perfume components, preferably at least one component comprising a coating agent and/or carrier material, preferably organic polymer carrying the perfume or alumniosilicate carrying the perfume, or an encapsulate enclosing the perfume, for example starch or other cellulosic material encapsulate. Preferably the compositions of the present invention comprise from 0.01% to 10% of perfume, more preferably from 0.1% to 3%. The different compartments herein can comprise different types and levels of perfume.

The compositions herein can comprise fabric softening clays. Preferred fabric softening clays are smectite clays, which can also be used to prepare the organophilic clays described hereinafter, for example as disclosed in EP-A-299575 and EP-A-313146. Specific examples of suitable smectite clays are selected from the classes of the bentonites—also known as montmorillonites, hectorites, volchonskoites, nontronites, saponites and sauconites, particularly those having an alkali or alkaline earth metal ion within the crystal lattice structure. Preferably, hectorites or montmorillonites or mixtures thereof. Hectorites are most preferred clays. Examples of hectorite clays suitable for the present compositions include Bentone EW as sold by Elementis.

Another preferred clay is an organophilic clay, preferably a smectite clay, whereby at least 30% or even at least 40% or preferably at least 50% or even at least 60% of the exchangeable cations is replaced by a, preferably long-chain, organic cations. Such clays are also referred to as hydrophobic clays. The cation exchange capacity of clays and the percentage of exchange of the cations with the long-chain organic cations can be measured in several ways known in the art, as for example fully set out in Grimshaw, The Chemistry and Physics of Clays, Interscience Publishers, Inc.,pp. 264–265 (1971). Highly preferred are organophilic clays as available from Rheox/Elementis, such as Bentone SD-1 and Bentone SD-3, which are registered trademarks of Rheox/Elementis.

The compositions herein preferably comprise a bleaching system, especially a perhydrate bleach system. Examples of prehydrate bleaches include salts of percarbonates, particularly the sodium salts, and/or organic peroxyacid bleach precursor, and/or transition metal bleach catalysts, especially those comprising Mn or Fe. It has been found that when the pouch or compartment is formed from a material with free hydroxy groups, such as PVA, the preferred bleaching agent comprises a percarbonate salt and is preferably free form any perborate salts or borate salts. It has been found that borates and perborates interact with these hydroxy-containing materials and reduce the dissolution of the materials and also result in reduced performance. Inorganic perhydrate salts are a preferred source of peroxide. Examples of inorganic perhydrate salts include percarbonate, perphosphate, persulfate and persilicate salts. The inorganic perhydrate salts are normally the alkali metal salts. Alkali metal percarbonates, particularly sodium percarbonate are preferred perhydrates herein.

The compositions herein preferably comprises a peroxy acid or a precursor therefor (bleach activator), preferably comprising an organic peroxyacid bleach precursor. It may be preferred that the composition comprises at least two peroxy acid bleach precursors, preferably at least one hydrophobic peroxyacid bleach precursor and at least one hydrophilic peroxy acid bleach precursor, as defined herein. The production of the organic peroxyacid occurs then by an in-situ reaction of the precursor with a source of hydrogen peroxide. The hydrophobic peroxy acid bleach precursor preferably comprises a compound having a oxy-benzene sulphonate group, preferably NOBS, DOBS, LOBS and/or NACA-OBS, as described herein. The hydrophilic peroxy acid bleach precursor preferably comprises TAED.

Amide substituted alkyl peroxyacid precursor compounds can be used herein. Suitable amide substituted bleach activator compounds are described in EP-A-0170386.

The compositions may contain a pre-formed organic peroxyacid. A preferred class of organic peroxyacid compounds are described in EP-A-170,386. Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Another preferred ingredient useful in the compositions herein is one or more enzymes. Suitable enzymes include enzymes selected from peroxidases, proteases, gluco-amylases, amylases, xylanases, cellulases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, dextranase, transferase, laccase, mannanase, xyloglucanases, or mixtures thereof. Detergent compositions generally comprise a cocktail of conventional applicable enzymes like protease, amylase, cellulase, lipase.

The compositions herein are preferably not formulated to have an unduly high pH. Preferably, the compositions of the present invention have a pH, measured as a 1% solution in distilled water, of from 7.0 to 12.5, more preferably from 7.5 to 11.8, most preferably from 8.0 to 11.5.

Pouches

The pouches herein can be of any form which is suitable to hold the compositions, e.g. without allowing the substantial release of composition from the pouch prior to use. The exact execution will depend on, for example, the type and amount of the composition in the pouch, the number of compartments in the pouch, the characteristics required from the pouch to hold, protect and deliver or release the compositions. The pouch may be of any suitable size but it is preferred that it conveniently contains either a unit dose amount of the composition herein, suitable for the required operation, for example one wash, or only a partial dose, to allow the consumer greater flexibility to vary the amount used, for example depending on the size and/or degree of soiling of the wash load.

EXAMPLES

Example I

A low pressure of 500 mbar is used to draw a layer of 38 micron Monosol 8630 PVA film into a 4.85 cm diameter, 47 cc, cylindrical mould containing 5 vacuum ports arranged at the bottom of the mould. This film is then perforated with a single pin prick at each of the 5 vacuum ports and the mould is partially filled with 30 grams of granular detergent. A second layer of 38 micron Monosol 8630 PVA film is then vacuum drawn into the mould (through the perforations on the bottom film). The remaining volume in the mould is substantially filled with 10 grams of liquid detergent. A third layer of 38 micron Monosol M-8630 PVA film was then placed on top of the mould, and the entire assembly was heat sealed for 1 second at 155° C. and 2000 kN/m$^2$.

Example II

A vacuum of 500 mbar is used to draw a layer of 38 micron Monosol 8630 PVA film into a 4.85 cm diameter, 47 cc, cylindrical mould containing 5 vacuum ports arranged at the bottom of the mould. This film is then perforated with a single pin prick at each of the 5 vacuum ports and the mould is partially filled with 30 grams of granular detergent. A second layer of 38 micron Monosol 8630 PVA film is then sealed to the first film by heat sealing at 155° C. for 0.2 seconds and 2000 kN/m$^2$ and drawn into the mould (through the vacuum being applied through perforations on the bottom film). The remaining volume in the mould is substantially filled with 10 grams of liquid detergent. A third layer of Monosol 8630 PVA film was then coated with a uniform layer of solvent by a Meyer bar applicator and sealed to the second film using a temperature of 80° C. and a pressure of 2000 kN/m$^2$. The solution used was 45% water, 45% 1,2-propandiol and 10% PVA and the Meyer bar applicator designed to give a uniform layer of 16 microns thickness.

What is claimed is:

1. A process for forming water-soluble pouches comprising the steps:

(a) drawing a first layer of film into a mould to form a first compartment;

(b) adding a particulate composition to said first compartment;

(c) forming a second compartment over said first compartment by drawing a second layer of film into said mould;

wherein the second compartment comprises a composition and the second layer of film is drawn in to the mould by means of suction applied through at least one perforation in the first layer of film.

2. A process according to claim 1 wherein said particulate composition is a cleaning composition.

3. A process according to claim 1 wherein the perforation in said first layer of film has a diameter of less than about 2 mm.

4. A process according to claim 1 wherein the suction applied to said second layer of film is from about 950 to about 30 mbar.

5. A process according to claim 1 wherein the film of said first and second layers is selected from the group consisting of: polyacrylates and water-soluble acrylate copolymers; methylcellulose; carboxymethylcellulose sodium; dextrin; ethylcellulose; hydroxyethyl cellulose; hydroxypropyl methylcellulose; maltodextrin; polymethacrylates; and mixtures thererof.

6. A process according to claim 1 wherein the film of said first and second layers is selected from the group consisting of: polyvinyl alcohols; polyvinyl alcohol copolymers and hydroxypropyl methyl cellulose; and mixtures thereof.

* * * * *